US006918515B2

(12) United States Patent
Noguchi

(10) Patent No.: US 6,918,515 B2
(45) Date of Patent: Jul. 19, 2005

(54) LIQUID CONTAINER

(75) Inventor: Yoshio Noguchi, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/653,092

(22) Filed: Sep. 3, 2003

(65) Prior Publication Data

US 2004/0042841 A1 Mar. 4, 2004

(30) Foreign Application Priority Data

Sep. 4, 2002 (JP) ..... 2002-258379

(51) Int. Cl.[7] ..... G01F 11/00

(52) U.S. Cl. ..... 222/386; 222/340; 222/491; 222/494; 401/172; 401/270

(58) Field of Search ..... 222/386, 390, 222/340, 490, 491, 494; 401/277, 270, 172

(56) References Cited

U.S. PATENT DOCUMENTS 2,305,158 A 12/1942 Hanses
2,587,794 A 3/1952 Glenn et al.
4,309,119 A * 1/1982 Wittersheim ..... 401/188 R
4,776,717 A * 10/1988 Iizuka et al. ..... 401/176
4,808,022 A * 2/1989 Iizuka et al. ..... 401/176
4,892,427 A * 1/1990 Ford ..... 401/182
5,803,640 A 9/1998 Nakajima et al.
6,176,632 B1 * 1/2001 Kageyama et al. ..... 401/186
6,702,158 B2 * 3/2004 Kageyama et al. ..... 222/386

FOREIGN PATENT DOCUMENTS

GB 1 455 067 11/1976

OTHER PUBLICATIONS

European Search Report dated Nov. 10, 2003.

* cited by examiner

*Primary Examiner*—Frederick C. Nicolas
(74) *Attorney, Agent, or Firm*—McGinn & Gibb, PLLC

(57) ABSTRACT

In a liquid container, the dimension of inside diameter of a liquid supply portion is not subject to any restriction, and also a liquid leakage suppressing mechanism that is not subject to any restriction by the viscosity of stored liquid is provided. A liquid container includes a body having a tank for storing a liquid; a supply mechanism which is connected to the tip end portion of the body and has a brush for supplying the liquid; and a drive mechanism for pushing out the liquid L in the tank T to the supply mechanism. A valve which is normally closed and can be opened only when the drive mechanism is operated is provided between the tank and the supply mechanism.

14 Claims, 3 Drawing Sheets

LIQUID CONTAINER

BACKGROUND OF THE INVENTION

1. Field of the Invention

The present invention relates to a liquid container for storing a liquid having a relatively low viscosity such as lotion, error-correcting liquid, writing ink and cosmetic liquid. More particularly, it relates to a liquid container having an improved tightness and capable of preventing liquid leakage.

2. Description of the Related Art

Conventionally, as a liquid container of this type, a liquid applying device has been known which is provided with a coating liquid supply element, which is also operated as a liquid leakage suppressing mechanism, between an applier and a body to prevent the coating liquid from leaking into a cap due to expansion of gas intruding into the coating liquid or the interior of the body, drop, vibration, etc. (for example, see Japanese Patent Laid-Open No. 2002-165637). Particularly, this liquid leakage suppressing mechanism is comprised of the coating liquid supply elements consisting of two pipe-shaped parts. One coating liquid supply element consists of a cylindrical part in which the content volume thereof is set so as to be equal to or more than the amount of expansion predicted in advance so as to accommodate the expansion of coating liquid stored in the body due to heating and/or due to decompression of intruding gas, and the other coating liquid supply element has a transverse cross-sectional shape such that three or more protrusions extending from the internal wall surface toward the center are provided. Thereby, the coating liquid is prevented from leaking into the cap due to drop, vibration, etc.

However, because such a liquid leakage suppressing mechanism also serves as the coating liquid supply element, a problem is that since two opposing functions of supplying coating liquid and suppressing liquid leakage are provided by one single part, each of the functions cannot be fulfilled satisfactorily. Therefore, another problem is that the viscosity of liquid stored in the body is limited by the inside diameter of the coating liquid supply element.

SUMMARY OF THE INVENTION

The present invention has been made to solve the above problems, and accordingly an object thereof is to provide a liquid container in which the dimensions such as inside diameter of a supply mechanism are not subject to any restriction by the viscosity of liquid, and hence a liquid leakage suppressing mechanism that is not subject to any restriction by the viscosity of stored liquid is provided.

To achieve the above object, a liquid container according to the present invention including a body having a tank for storing a liquid, a supply mechanism which is connected to the tip end portion of the body and has a tip end supply element for supplying the liquid, and a drive mechanism for pushing out the liquid in the tank to the supply mechanism. The liquid container includes a valve which is normally closed and can be opened only when the drive mechanism is operated, provided between the tank and the supply mechanism.

Since the supply mechanism is normally isolated from the tank by the valve, the tank is sealed and closed, so that the liquid in the tank does not leak. On the other hand, when the liquid in the tank is desired to be supplied to the supply mechanism, the liquid in the tank is pushed out to the supply mechanism by driving the drive mechanism, by which the valve is opened, so that the tank communicates with the supply mechanism. Thereby, the liquid in the tank is supplied to the supply mechanism, and can be supplied to an object through the tip end supply element. When the liquid in the tank is supplied to the supply mechanism and the pressure in the tank decreases, the valve returns to the normal state and is closed. The valve configured as described above can surely prevent even a liquid having a low viscosity from leaking. Also, since the supply mechanism is normally isolated from the tank, the dimensions etc. of the supply mechanism are not subject to any restriction by the viscosity of liquid.

The valve can be made of an elastic material, and have a plate portion which separates the supply mechanism from the tank, and is formed with a slit in a central portion of the plate portion. Thereby, the valve can be constructed easily at a low cost. Also, since the plate portion does not occupy the volume of tank greatly, the effective volume of the tank is not decreased greatly.

The present disclosure relates to subject manner contained in Japanese Patent Application No. 2002-258379, filed on Sep. 4, 2002, which is expressly incorporated herein by reference in its entirety.

DETAILED DESCRIPTION OF THE PREFERRED EMBODIMENTS

An embodiment of the present invention will now be described with reference to the accompanying drawings.

Figure 1:
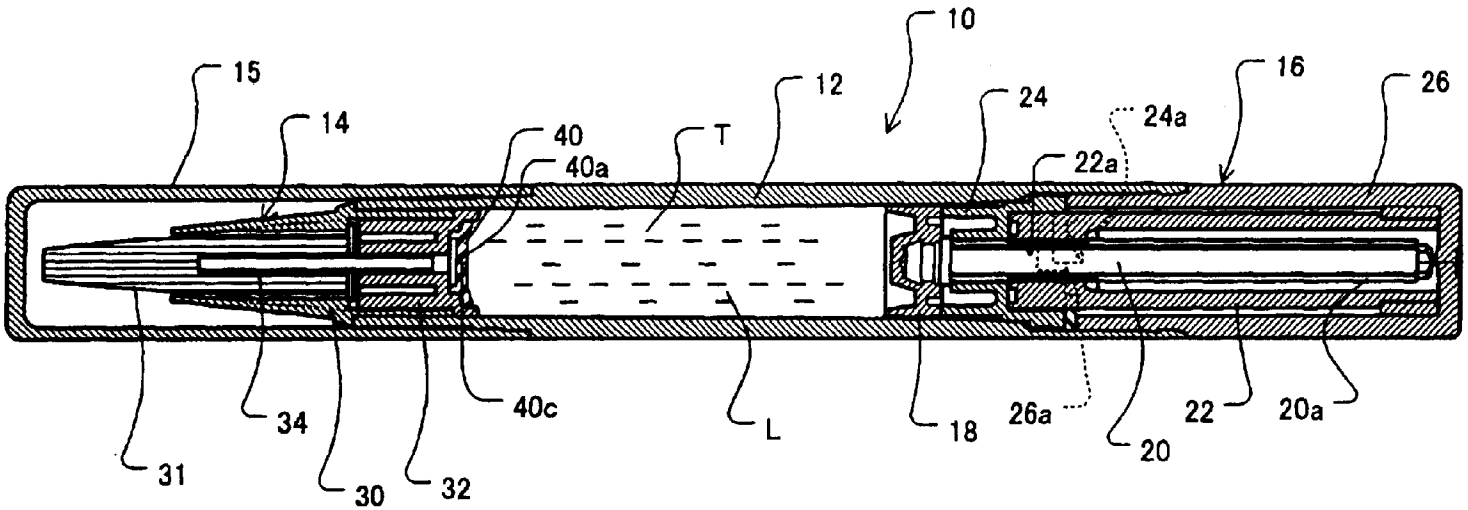
FIG. 1 is a longitudinal sectional view showing an embodiment of a liquid container in accordance with the present invention.

FIG. 1 is a longitudinal sectional view showing an embodiment of a liquid container in accordance with the present invention. In FIG. 1, a liquid container 10 includes a body 12 which defines a tank T for storing a liquid L such as an error-correcting liquid, writing ink, or cosmetic ink, a supply mechanism 14 which is connected to the tip end portion of the body 12, a drive mechanism 16 which is connected to the rear end portion of the body 12, and a cap 15 which is put detachably on the body 12 to cover the supply mechanism 14.

The drive mechanism 16 has a piston 18 which slides in the tank T, a piston rod 20 which is connected to the piston 18, extending rearward, and is formed with external threads 20*a*, a piston rod guide 22 which is formed with internal threads 22*a* threadably engaged with the external threads 20*a* of the piston rod 20, a ratchet 24 which is fixed in the body 12 and has a center hole through which the piston rod 20 passes so as to be unrotatable relative to the ratchet 24, and a driver 26 which is installed at the rear end of the body 12 and accommodates the piston rod guide 22 so as to be unrotatable relative to the driver 26. At the tip end of the driver 26, ratchet teeth 26*a* are formed continuously, and also ratchet teeth 24*a* are formed at the rear end of the ratchet 24 so as to be displaceable in the axial direction. The ratchet teeth 26*a* of the driver 26 mate with the ratchet teeth 24*a* of the ratchet 24, by which th direction of turning of the driver 26 is restricted to one direction, and also a sense of click is produced. By turning the driver 26 in one direction, the piston rod guide 22 is turned in the same direction. On the other hand, the piston rod 20 threadably engaging with the piston rod guide 22 advances because the turning motion thereof is inhibited by the ratchet 24. Thereby, the piston 18 is pushed out, and hence the liquid L in the tank T is pushed out to the supply mechanism 14.

The supply mechanism 14 has a tip end member 30 which is press-fitted into the tip end portion of the body 12, a guide tube holder (holding member) 32 which is fixed at the rear of the tip end member 30, a liquid guide tube 34 which is fixed at the tip end of the guide tube holder 32 and is held by the guide tube holder 32, and a brush (tip end supply element) 31 in which the distal end of the liquid guide tube 34 is inserted in the proximal portion thereof and the proximal portion is fixed in the tip end member 30.

Figure 2A:
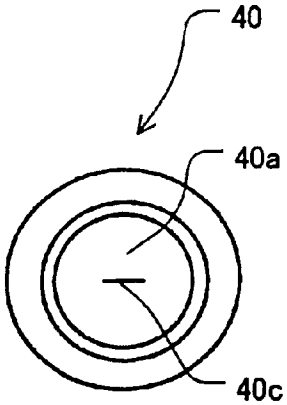
FIG. 2A is a back view of a valve.
Figure 2B:
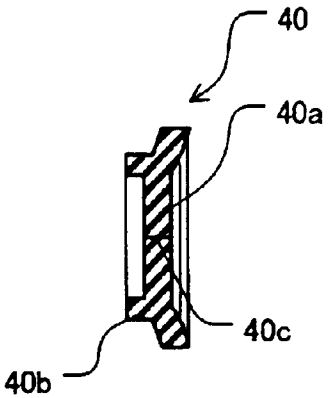
FIG. 2B is a longitudinal sectional view of the valve.

In the tip end portion of the tank T, a valve 40 is disposed so as to separate the supply mechanism 14 from the tank T. The valve 40 is made of an elastic material such as soft plastics, synthetic rubber, and thermoplastic elastomer, and is constructed by a plate portion 40*a* and a seating portion 40*b* as shown in FIG. 2. Th seating portion 40*b* is fitted in a concave portion formed at the rear end of the guide tube holder 32 by its elasticity. The valve 40 can be constructed by the plate portion 40*a* only by omitting the seating portion 40*b*, and the plate portion 40*a* may be pressed in and fitted in the concave portion in the guide tube holder 32.

In the central portion of the plate portion 40*a*, a slit 40*c* is formed. In a state in which pressures on both sides of the plate portion 40*a* are approximately equal, the plate portion 40*a* is urged by the elasticity the material itself has so as to be in a state in which the slit 40*c* is closed, that is, in a state in which the valve 40 is closed. When the pressure on one side of the plate portion 40*a* is higher to some extent than the pressure on the opposite side, the plate portion 40*a* is deformed into a curved shape and the slit 40*c* is opened. Thereupon, the valve 40 operates so as to decrease the difference in pressure by causing the liquid L to flow through the opened portion.

Figure 3:
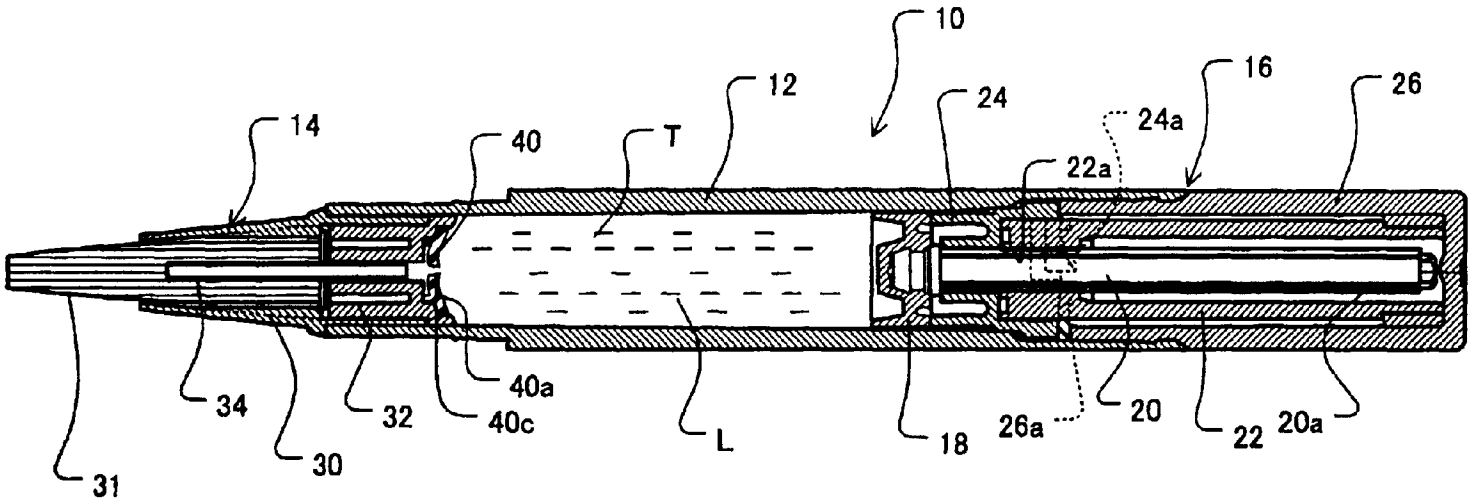
FIG. 3 is a longitudinal sectional view showing a state in which a valve of a liquid container in accordance with the present invention is open.

In the liquid container constructed as described above, when the liquid container is used, the cap 15 is removed, and the liquid L is applied to an object by using the brush 31. If the liquid L is not supplied sufficiently to the brush 31, the driver 26 of the drive mechanism 16 is turned in the fixed direction with respect to the body 12. By turning the driver 26, the piston rod guide 22 is turned. When the piston rod guide 22 is turned, the piston rod 20 threadably engaged with the piston rod guide 22 moves in the advance direction in the body 12 because the rotation thereof is inhibited by the ratchet 24. Thereupon, the piston 18 connected to the piston rod 20 slides in the tank T. Thereby, the pressure of the liquid L in the tank T is increased, and the plate portion 40*a* of the valve 40 is deformed to open the slit 40*c* (FIG. 3). Thus, the liquid L pushed out by the piston 18 is introduced from the tank T into the liquid guide tube 34, and is guided to the brush 31. When the liquid L is discharged to the supply mechanism 14 side in this manner, the pressure in the tank T decreases, and hence the valve 40 returns to the original state, by which the slit 40*c* is closed.

At the normal time when the drive mechanism 16 is not operated, the valve 40 is closed, so that the tank T is sealed and closed. Therefore, even if the liquid L stored in the tank T is a liquid having a high dilution and a low viscosity, liquid leakage does not occur. Also, since the supply mechanism 14 is normally isolated from the tank T, the dimensions etc. of the supply mechanism 14 are not subject to any restriction by the viscosity of liquid. Also, since the closed state of the tank T is secured at the normal state, a liquid having a high volatility can be stored in the tank T. Also, even a liquid having a low viscosity does not leak even if vibrations etc. occur.

Since the valve 40 is mainly made up of the plate portion 40*a*, the valve 40 can be constructed easily at a low cost, and the occupied space thereof is small, so that the effective volume of the tank T is not decreased greatly. Since the valve 40 can be fixed in the concave portion at the rear end of the guide tube holder 32, which is the holding member, by utilizing the elasticity thereof, the valve 40 is easy to install.

While the principles of the invention have been described above in connection with specific embodiments, and particular modifications thereof, it is to be clearly understood that this description is made only by way of example and not as a limitation on the scope of invention.

What is claimed is:

1. A liquid container comprising:

a body comprising a tank for storing a liquid;

a supply mechanism which is connected to a tip end portion of said body and comprising a tip end supply element for supplying the liquid;

a drive mechanism for pushing out the liquid in said tank to said supply mechanism; and a valve, that is normally closed and opened only when said drive mechanism is operated, between said tank and said supply mechanism, wherein the valve comprises a slit in a plate portion, wherein the valve comprises a seating portion abutting the supply mechanism, and wherein the seating portion is fitted to a concave portion of a guide tube holder in the supply mechanism.

2. The liquid container according to claim 1, wherein said valve comprises an elastic material, wherein the plate portion separates said supply mechanism from said tank, and the slit is in a central portion of said plate portion.

3. The container of claim 1, wherein the seating portion is fitted to the guide tube holder by the elasticity of the valve.

4. The container of claim 1, wherein the slit opens only when the drive mechanism is operated.

5. The container of claim 1, wherein operation of the drive mechanism increases a pressure in the liquid storage tank that opens the slit.

6. A liquid container comprising a body comprising a liquid storage tank;

a supply mechanism connected to the body;

a drive mechanism connected to the body; and a valve comprising a slit in a plate portion, wherein the valve comprises a seating portion abutting the supply mechanism, and wherein the seating portion is fitted to a concave portion of a guide tube holder in the supply mechanism.

7. The container of claim 6, wherein the slit is in a central portion of the plate portion.

8. The container of claim 6, wherein the valve separates the supply mechanism from the liquid storage tank.

9. The container of claim 6, wherein the supply mechanism comprises a tip end supply element.

10. The container of claim 6, wherein operation of the drive mechanism pushes a liquid from the liquid storage tank to the supply mechanism.

11. The container of claim 6, wherein the valve comprises an elastic material.

12. The container of claim 6, wherein the seating portion is fitted to the guide tube holder by the elasticity of the valve.

13. The container of claim 6, wherein the slit opens only when the drive mechanism is operated.

14. The container of claim 6, wherein operation of the drive mechanism increases a pressure in the liquid storage tank that opens the slit.

* * * * *